US006017196A

United States Patent [19]

Wu

[11] Patent Number: 6,017,196

[45] Date of Patent: Jan. 25, 2000

[54] BICYCLE INFLATOR

[76] Inventor: Scott Wu, P.O. Box 63-247, Taichung, Taiwan

[21] Appl. No.: 09/010,984

[22] Filed: Jan. 22, 1998

[51] Int. Cl.[7] ..... F04B 53/00

[52] U.S. Cl. ..... 417/234; 417/553

[58] Field of Search ..... 417/234, 553

[56] References Cited

U.S. PATENT DOCUMENTS

| | | | |
|---|---|---|---|
| 5,324,174 | 6/1994 | Diotte | 417/234 |
| 5,338,166 | 8/1994 | Schultz | 417/553 |
| 5,347,913 | 9/1994 | Stepner | 417/234 |
| 5,443,370 | 8/1995 | Wang | 417/553 |
| 5,476,372 | 12/1995 | Yang | 417/553 |
| 5,494,411 | 2/1996 | Chuang | 417/234 |
| 5,538,398 | 7/1996 | Elson | 417/234 |

*Primary Examiner*—John Kwon
*Attorney, Agent, or Firm*—Charles E. Baxley Esq.

[57] ABSTRACT

A bicycle inflator includes a cylinder having a cap fixedly received in a first end thereof and an end member fixedly received in a second end of the cylinder. The cap has a passage defined therethrough. The end member has a tubular portion extending downwardly from a bottom thereof and the tubular portion has a cut-away defined through a periphery thereof so that a pawl member extending from the bottom is received in the cut-away. A piston rod extends through the end member and is connected to a piston member in the cylinder. A handle has a first end and a second end which is pivotally connected to the piston rod. A longitudinal recess is defined through a periphery of the handle and sized to allow the piston rod to pass therethrough. Each of two opposite inner sides defining the longitudinal recess has a notch defined therein and located near the first end so as to receive the pawl member when the handle is not used. Two protrusions respectively extend from the two respective opposite inner sides defining the longitudinal recess and are located near the second end of the handle.

13 Claims, 7 Drawing Sheets

BICYCLE INFLATOR

BACKGROUND OF THE INVENTION

1. Field of the Invention

The present invention relates to a bicycle inflator and, more particularly, to an improved bicycle inflator having a handle pivotally connected to a piston rod and the handle can be perpendicularly positioned relative to a piston rod of the inflator.

2. Brief Description of the Prior Art

A bicycle inflator generally is attached to a downward tube of a bicycle and includes a cylinder into which a piston is movably received. The piston is connected to a first end of a piston rod which has a second end thereof extending through the cylinder and connected to a handle. The piston can be reciprocatly moved in the cylinder by operating the piston rod to inflate a tire. The handle is designed to be pivotally connected to the second end of the handle and is able to be perpendicularly pivoted to the piston rod so as to facilitate the operation of the handle. However, the handle cannot be well positioned relative to the piston rod when inflating the tire so that a user cannot firmly hold the handle and push the handle together with the piston rod. That is to say, the handle is simply pivotal to the piston rod and the user has to hold the handle and maintain the handle in a position perpendicular to the piston rod. Such a conventional design of the handle results in an inconvenient operation when inflating a tire so that it takes time to use the conventional inflator.

The present invention intends to provide an improved bicycle inflator to mitigate and/or obviate the above-mentioned problems.

SUMMARY OF THE INVENTION

In one aspect of the present invention, there is provided a bicycle inflator comprising a cylinder having a first end with a cap fixedly received therein and a second end. The cap has a passage defined therethrough. An end member is fixedly recevied in the second end of the cylinder and has a bottom with a peripheral wall extending upwardly from the bottom. A tubular portion extends downwardly from an underside of the bottom and has a cut-away defined through a periphery thereof. A pawl member extends downwardly from the bottom and is received in the cut-away. A first hole and a second hole are respectively defined in the bottom and the tubular portion.

A piston rod has a first end and a second end. The piston rod has the first end thereof extending through the second hole and the first hole and is connected to a piston member which is movably received in the cylinder.

A handle has a first end being an open end and a second end which is pivotally connected to the second end of the piston rod. A longitudinal recess is defined through a periphery of the handle and sized to allow the piston rod to pass therethrough. Each of two opposite inner sides defining the longitudinal recess has a notch defined therein and located near the open end so as to receive the pawl member when the handle is not used. Two protrusions respectively extend from the two respective opposite inner sides defining the longitudinal recess and are located near the second end of the handle.

It is an object of the present invention to provide a bicycle inflator having a handle which is able to be pivoted perpendicularly to the piston rod.

It is another object of the present invention to provide a bicycle inflator having a handle which is pivotally connected to the piston rod and easily to be positioned perepndicularly to the piston rod.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
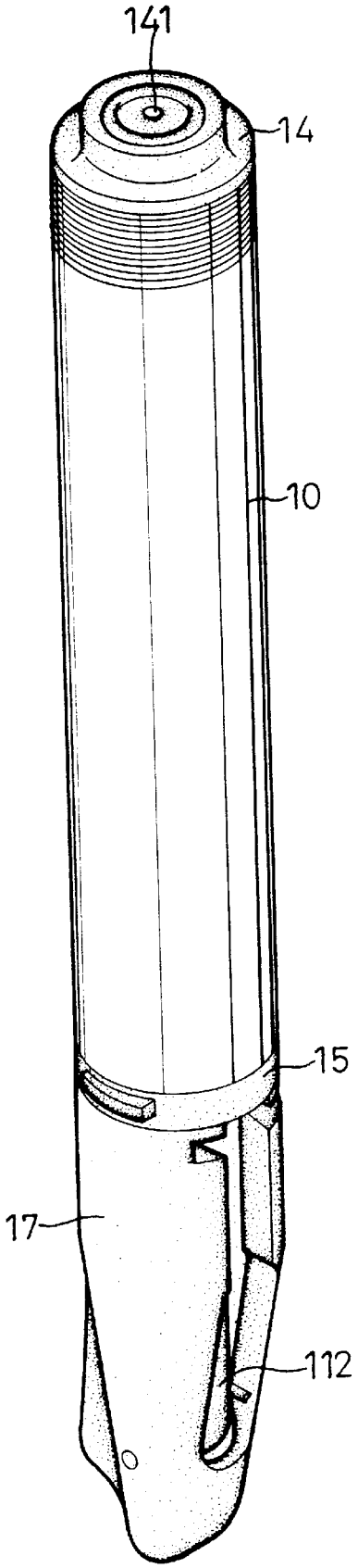
FIG. 1 is a perspective view of a bicycle inflator in accordance with the present invention.
Figure 2:
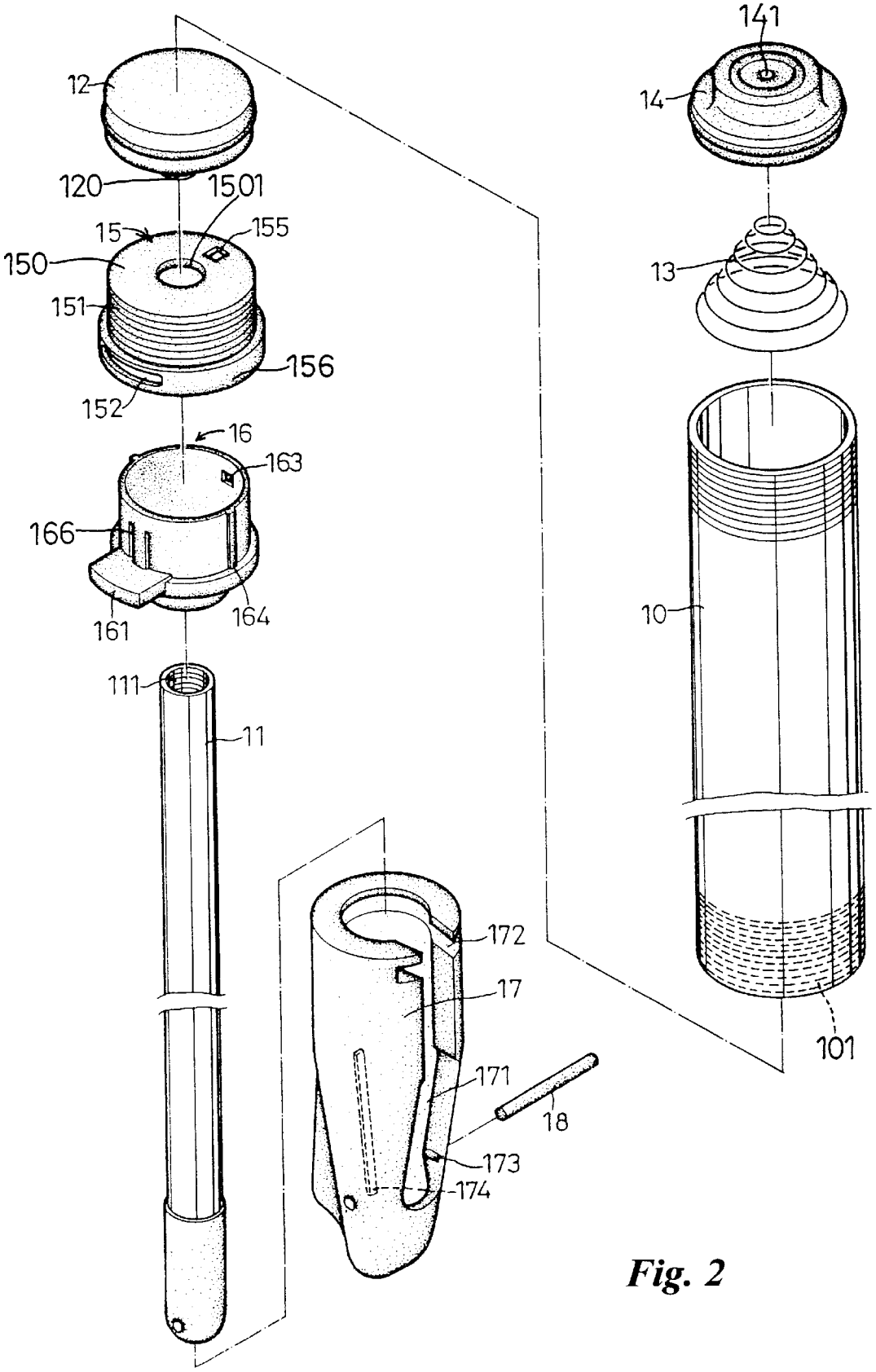
FIG. 2 is an exploded view of the bicycle inflator in accordance with the present invention.
Figure 2A:
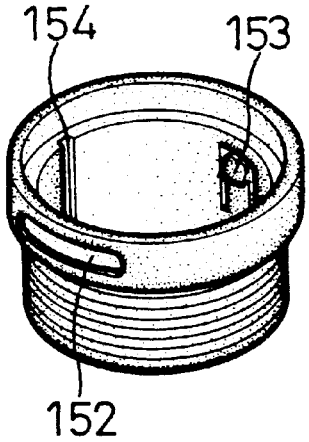
FIG. 2A is a perspective view of a positioning member which is seen from a bottomside of the positioning member.
Figure 2B:
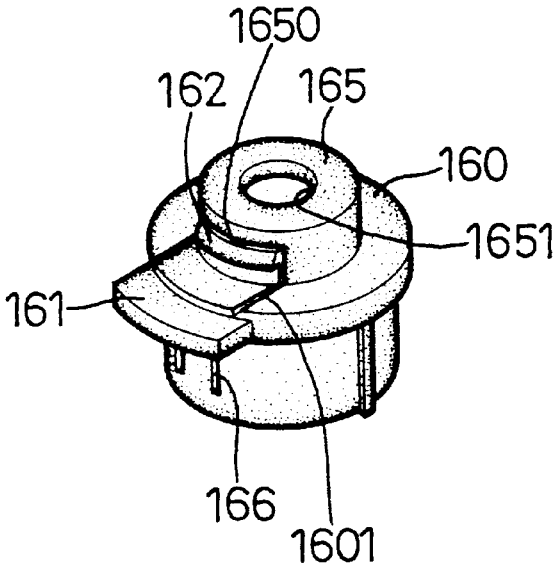
FIG. 2B is a perspective view of an end member which is seen from a bottomside of the end member.
Figure 3:
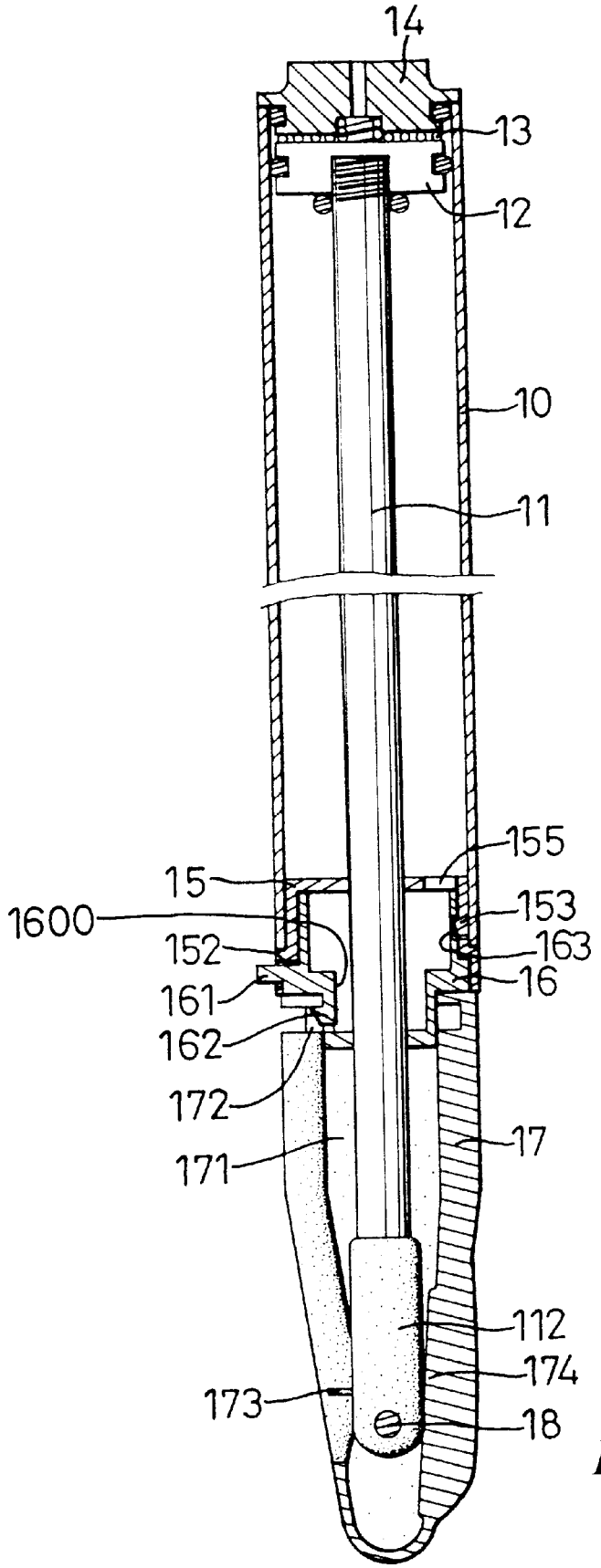
FIG. 3 is a side elevational view, partly in section, of the bicycle inflator of present invention when not in use.

Referring to the drawings and initially to FIGS. 1, 2, 2A, 2B and 3, a bicycle inflator in accordance with the present invention generally includes a cylinder 10 having a first end and a second end, a cap 14 fixedly received in the first end of the cylinder 10 and having a passage 141 defined therethrough. The cylilnder 10 has a first threaded portion 101 defined in an inner periphery of the second end thereof.

A positioning member 15 is fixedly received in the second end of the cylinder 10 and has a top 150 with a first hole 1501 defined through the top 150. A first peripheral wall extends downwardly from the top 150 and a skirt portion 150 extends radially from a lower end of the first peripheral wall. An outer threaded portion 151 is defined in the first peripheral wall so as to be engaged with the first theaded portion 101. The skirt portion 156 has a slot 152 defined therethrough. A flexible hook member 153 is formed in and toward inwardly from the first peripheral wall of the positioning member. Two keyways 154 are defined in an inner peripehry of the first peripheral wall.

An end member 16 has a bottom 160 and a second peripheral wall extending upwardly from the bottom 160, two ridges 164 extending from the second peripheral wall so as to be received in the two keyways 154 when the second peripheral wall of the end member 16 is received in the first peripheral wall of the positioning member 15. The second peripheral wall has a first aperture 163 defined therethrough so as to receive the hook member 153 therein which is accessed via a second aperture 155 defined in the top 150 of the positioning member 15, if necessary. A tubular portion 165 extends downwardly from an underside of the bottom 160 and has a cut-away 1650 defined through a periphery thereof. A pawl member 162 extends downwardly from the bottom 160 and is received in the cut-away 1650. A plate 161 extends radially and outwardly from the bottom 160 of the end member 16 and movably extends through the slot 152 of the first member 15. Two first slits 1601 are defined in the bottom 160 and a width between the two first slits 1601 is eaqual to a respective width of the plate 161 and the pawl member 162. Two second slits 166 are further defined through the second peripheral wall of the end member 16 and ended at the plate 161 so that when pushing the plate 161, the pawl member 162 is pushed inwardly. A second hole 1600 and a third hole 1651 are respectively defined in the bottom 160 and the tubular portion 165.

A piston rod 11 has a first end thereof extending through the third hole 1651, the second hole 1600 and the first hole 1501. The first end of the piston rod 11 is fixedly connected to a piston member 12 wherein the first end of the piston rod 11 has a second inner threaded portion 111 defined in an inner periphery thereof so as to threadedly receive a threaded protrusion 120 extending centrally from the piston member 12 which is movably received in the cylinder 10. A spring 13 is biased between the piston member 12 and the cap 14.

A handle 17 has a first end being an open end and a second end which is pivotally connected to the second end of the piston rod 11 by a pin 18. A longitudinal recess 171 is defined through a periphery of the handle 17 and communicates with the open end. The longitudinal recess 171 is sized to allow the piston rod 11 to pass therethrough. Each of two opposite inner sides defining the longitudinal recess 171 has a notch 172 defined therein and located near the open end so as to receive the pawl member 162 when the handle 10 is not used. Two protrusions 173 respectively extend from the two respective opposite inner sides defining the longitudinal recess 171 and are located near the second end of the handle 10. The handle 17 has a rib 174 extends from an inner periphery thereof and is located in opposite to the longitudinal recess 171. A distance between the two protrusions 173 and a bottom defining the longitudinal recess 171 is sized to receive the second end of the piston rod 11.

Figure 4:
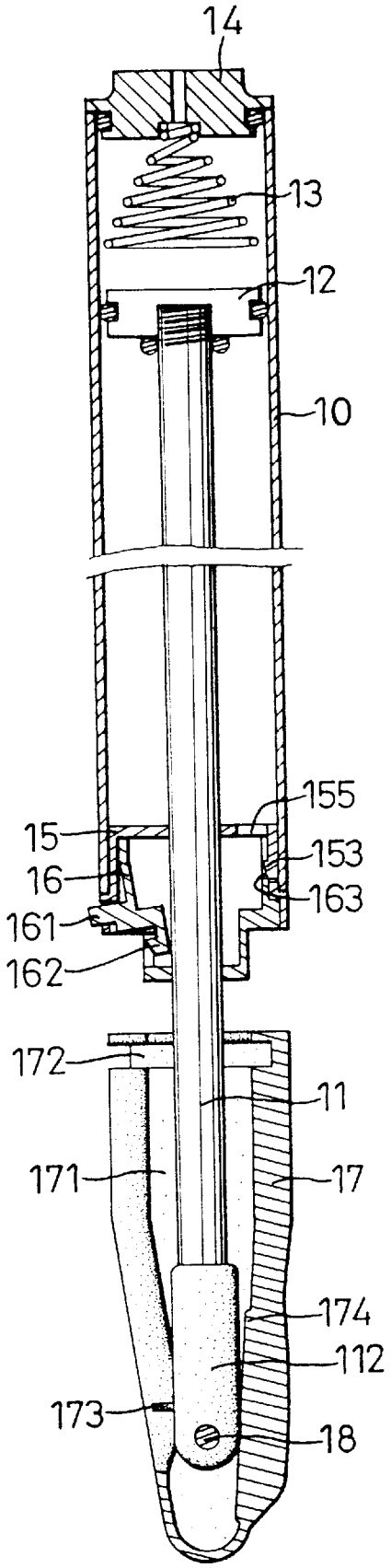
FIG. 4 is a side elevational view, partly in section, of the bicycle inflator of present invention when the handle is disengaged from the cylinder.
Figure 5:
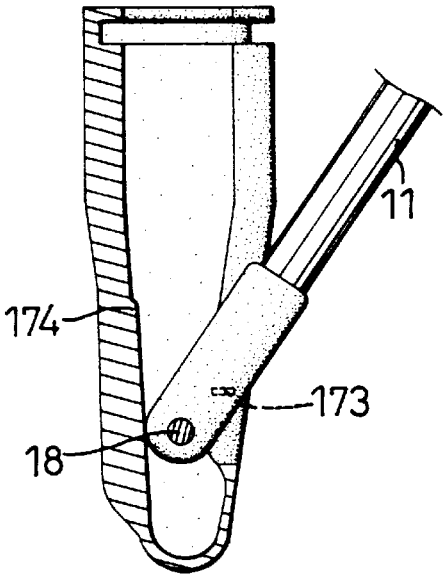
FIG. 5 is an illustrative view to show the piston rod being inclinedly pivoted about a pin and extending through a longitudinal recess of the handle.
Figure 6:
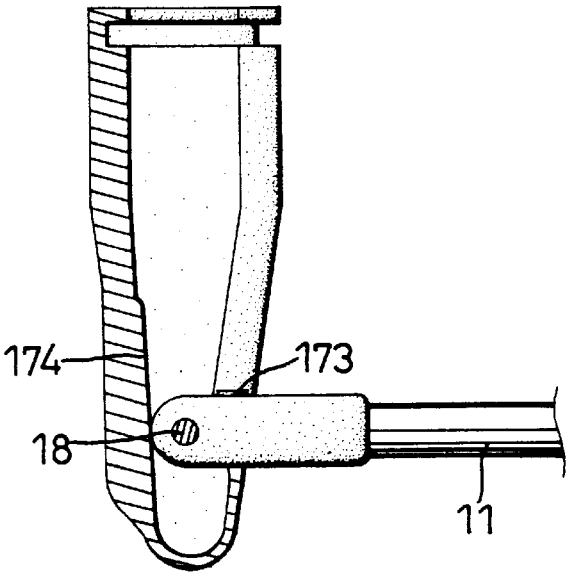
FIG. 6 is an illustrative view to show the piston rod being pivoted perpendicularly to the piston rod.
Figure 7:
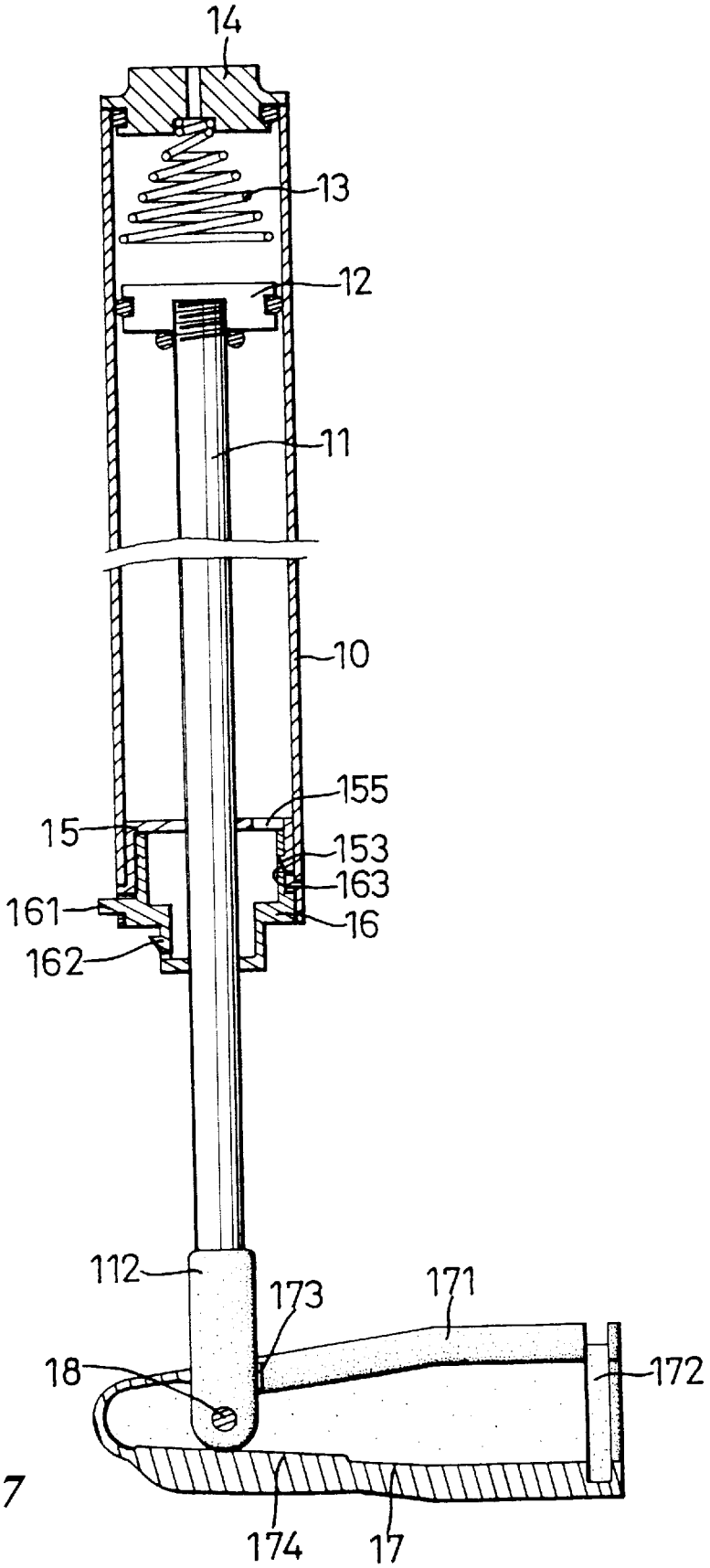
FIG. 7 is a side elevational view, partly in section, of the bicycle inflator of present invention when the handle is positioned perpendicularly to the piston rod.

Please refer to FIGS. 4 through 6, when using the inflator, the plate 161 is first pushed to move the pawl member 162 from the notches 172 and the piston rod 11 then popps out from the second end of the cylinder 10 by the spring 13 as shown in FIG. 4. The handle 17 is then pivoted about the pin 18 and let the piston rod 11 pass inclinedly through the longitudinal recess 171 with the second end of the piston rod 11 contacting against the rib 174 as shown in FIG. 5. The handle 17 is further pivoted about the pin 18 till the piston rod 11 moved across the two protrusions 173 and contacting against the bottom defining the longitudinal recess 171 while the two protrusions 173 limit a reverse movement of the piston rod 11 as shown in FIGS. 7 and 8. A user (not shown) then reciprocatally operates the piston rod 11 to inflate a tire (not shown) via the passage 141.

Accordingly, the handle 17 of the inflator of the present invention can be easily positioned perpendicularly to the piston rod 11 so as to perform a convenient operation of the inflator.

Although the invention has been explained in relation to its preferred embodiment, it is to be understood that many other possible modifications and variations can be made without departing from the spirit and scope of the invention as hereinafter claimed.

What is claimed is:

1. A bicycle inflator comprising:

a cylinder having a first end and a second end, a cap fixedly received in said first end of said cylinder and having a passage defined therethrough;

an end member fixedly recevied in said second end of said cylinder and having a bottom with a peripheral wall extending upwardly from said bottom, a tubular portion extending downwardly from an underside of said bottom and having a cut-away defined through a periphery thereof, a pawl member extending downwardly from said bottom and being received in said cut-away, a first hole and a second hole respectively defined in said bottom and said tubular portion;

a piston rod having a first end and a second end, said piston rod having said first end thereof extending through said second hole and said first hole, a piston member fixedly connected to said first end of said piston rod and movably received in said cylinder, and a handle having a first end being an open end and a second end which is pivotally connected to said second end of said piston rod, a longitudinal recess defined through a periphery of said handle and communicating with said open end of said handle, said longitudinal recess being sized to allow said piston rod to pass therethrough, each of two opposite inner sides defining said longitudinal recess having a notch defined therein and located near said open end so as to receive said pawl member when said handle is not used, two protrusions respectively extending from said two respective opposite inner sides defining said longitudinal recess and located near said second end of said handle.

2. The bicycle inflator as claimed in claim 1 wherein a positioning member is fixedly received in said second end of said cylinder and having a top with a third hole defined through the top, a first peripheral wall extending downwardly from said top so as to receive said peripheral wall of said end member therein, said first peripheral wall having a slot defined in a lower end thereof and a flexible hook member formed in of said positioning member.

3. The bicycle inflator as claimed in claim 1 wherein said lower end of said first peripheral wall has a skirt portion formed radially thereto through which said slot is defined.

4. The bicycle inflator as claimed in claim 1 wherein said peripheral wall of said end member has a first aperture defined therethrough so as to receive said hook member therein.

5. The bicycle inflator as claimed in claim 2 wherein said cylilnder has a first threaded portion defined in an inner periphery of said second end thereof and said positioning member has an outer threaded portion defined in said first peripheral wall thereof so as to be engaged with said first threaded portion.

6. The bicycle inflator as claimed in claim 2 wherein said top of said positioning member has a second aperture defined therethrough so as to access said hook member thereby.

7. The bicycle inflator as claimed in claim 1 wherein a spring is biased between said piston member and said cap.

8. The bicycle inflator as claimed in claim 1 or 2 wherein a plate extends radially and outwardly from said bottom of said end member and two first slits are defined in said bottom, a width between said two first slits being equal to a respective width of each of said plate and said pawl member, two second slits defined through said peripheral wall of said end member and ended at said plate so that when pushing said plate, said pawl member is pushed away from said notches.

9. The bicycle inflator as claimed in claim 8 wherein said plate movably extends into said slot of said positioning member.

10. The bicycle inflator as claimed in claim 1 wherein said handle has a rib extends from an inner periphery thereof and is located in opposite to said longitudinal recess.

11. The bicycle inflator as claimed in claim 1 wherein a distance between said two protrusions and a bottom defining said longitudinal recess is sized to receive said second end of said piston rod.

12. The bicycle inflator as claimed in claim 1 wherein said piston member has a threaded protrusion extending centrally therefrom and said rod has a second inner threaded portion defined in an inner periphery of said first end thereof so as to threadedly receive said threaded protrusion.

13. The bicycle inflator as claimed in claim 2 wherein said positioning member has two keyways defined in an inner periphery of said first peripheral wall and said end member has two ridges extending from said peripheral wall thereof so as to be received in said two keyways.

* * * * *